US005529270A

United States Patent [19]

Liu

[11] Patent Number: 5,529,270

[45] Date of Patent: Jun. 25, 1996

[54] FOLDING COLLAPSIBLE STAND MOUNTING DEVICE

[76] Inventor: Lausan C. H. Liu, No. 243, Chien-Kuo Rd., Hsin-Tien City, Taipei Hsien, Taiwan

[21] Appl. No.: 371,976

[22] Filed: Jan. 12, 1995

[51] Int. Cl.[6] ..... F16M 11/16

[52] U.S. Cl. ..... 248/188; 248/166; 248/292.12; 297/31; 297/463.1; 403/230

[58] Field of Search ..... 248/188, 188.6, 248/166, 439, 291.1, 292.12; 297/31, 51, 16.1, 463.1, 54; 403/230, 321

[56] References Cited

U.S. PATENT DOCUMENTS

| | | | |
|---|---|---|---|
| 2,381,149 | 8/1945 | Wenneborg | 297/31 |
| 3,279,734 | 10/1966 | Kramer | 248/166 |
| 4,536,026 | 8/1985 | Cornell | 297/39 |
| 5,054,848 | 10/1991 | Liu | 297/39 |

FOREIGN PATENT DOCUMENTS

| | | | |
|---|---|---|---|
| 192020 | 8/1986 | European Pat. Off. | 297/16.1 |
| 644558 | 10/1950 | United Kingdom | 297/54 |

*Primary Examiner*—Karen J. Chotkowski
*Assistant Examiner*—Anita M. King
*Attorney, Agent, or Firm*—Bacon & Thomas

[57] ABSTRACT

A folding collapsible stand mounting device including a frame tube and a stand tube pivotably connected together by two symmetrical connecting plates, and a sliding lock moved along the frame tube for locking the stand tube in the operative position, wherein the sliding lock has a transverse locating rod and an end cap which are respectively engaged with the connecting plates and the frame tube to hold down the stand tube when the stand tube is turned to the operative position.

1 Claim, 7 Drawing Sheets

FOLDING COLLAPSIBLE STAND MOUNTING DEVICE

BACKGROUND OF THE INVENTION

The present invention relates to a folding collapsible stand mounting device, and relates more particularly to such a folding collapsible stand mounting device for folding collapsible deck chairs which is safe in use.

FIG. 1 shows a regular folding collapsible deck chair that can be folded up and arranged into A flat configuration when not in use. This folding collapsible deck chair is comprised of a frame made from steel tubes, a canvas stretched within the frame, and a plurality of folding stands respectively pivotably connected to the frame by respective connectors. As illustrated in FIG. 2, the connector is comprised of two substantially L-shaped connecting plates connected between the frame tube and one stand tube by rivets. When installed, the L-shaped connecting plates with the stand tube can be turned about the rivet on the frame tube between the operative position and the collapsed position. The L-shaped connecting plates have a respective raised portion at an inner side. When the L-shaped connecting plates are turned to the operative position, the raised portions of the L-shaped connecting plates are respectively moved into engagement with the frame tube of the deck chair to hold the stand tube in the operative position. When the stand tube is turned in the reversed direction, the raised portions are released from the frame tube, and therefore the stand tube can be turned to the collapsed position. Structure of folding collapsible deck chair is not safe in use because the raised portions of the L-shaped connecting plates tend to slip from position when the user moves the body while lying on the chair, causing the deck chair suddenly collapsed. Furthermore, the raised portions of the L-shaped connecting plates will be worn quickly with use.

SUMMARY OF THE INVENTION

The present invention has been accomplished to provide a folding collapsible stand mounting device which eliminates the aforesaid drawbacks. According to the present invention, a sliding lock is mounted around and moved along the frame tube for locking the stand tube in the operative position. The sliding lock has a transverse locating rod and an end cap which are respectively engaged with the connecting plates and the frame tube to hold down the stand tube when the stand tube is turned to the operative position.

DETAILED DESCRIPTION OF THE PREFERRED EMBODIMENT

Figure 1:
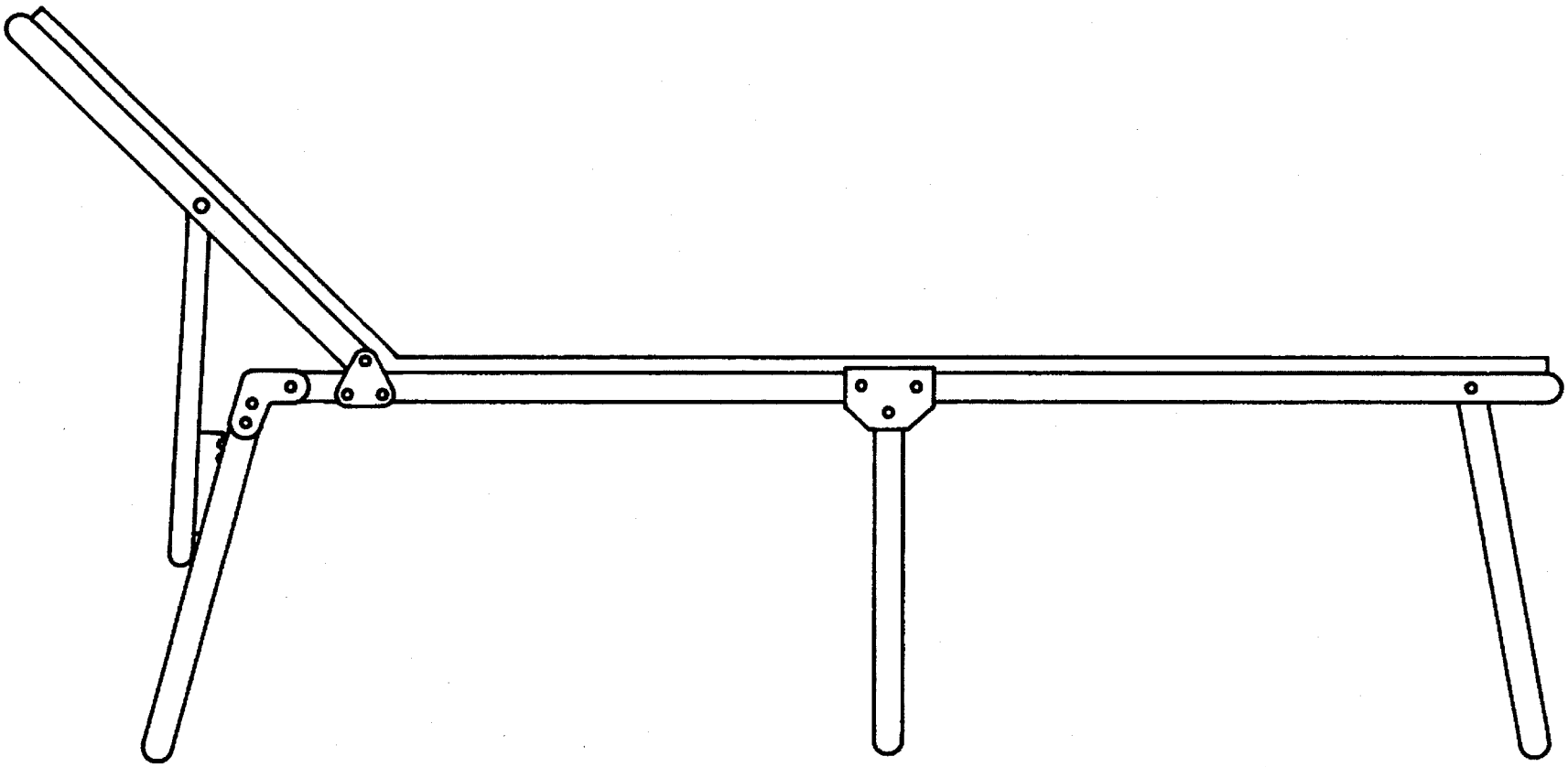
Fig. 1 PRIOR ART
FIG. 1 is a side elevation of a folding collapsible deck chair according to the prior art.
Figure 2:
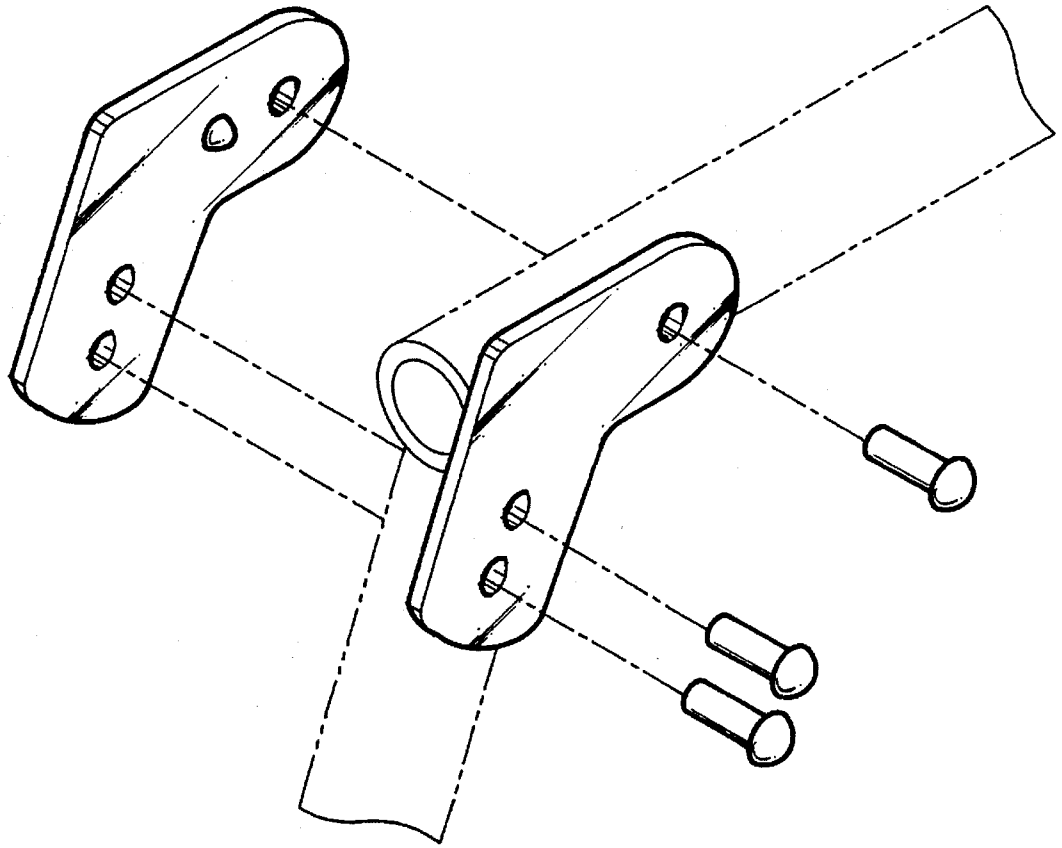
Fig. 2 PRIOR ART
FIG. 2 is an exploded view of a folding collapsible stand mounting connector for the folding collapsible deck chair shown in FIG. 1.
Figure 3:
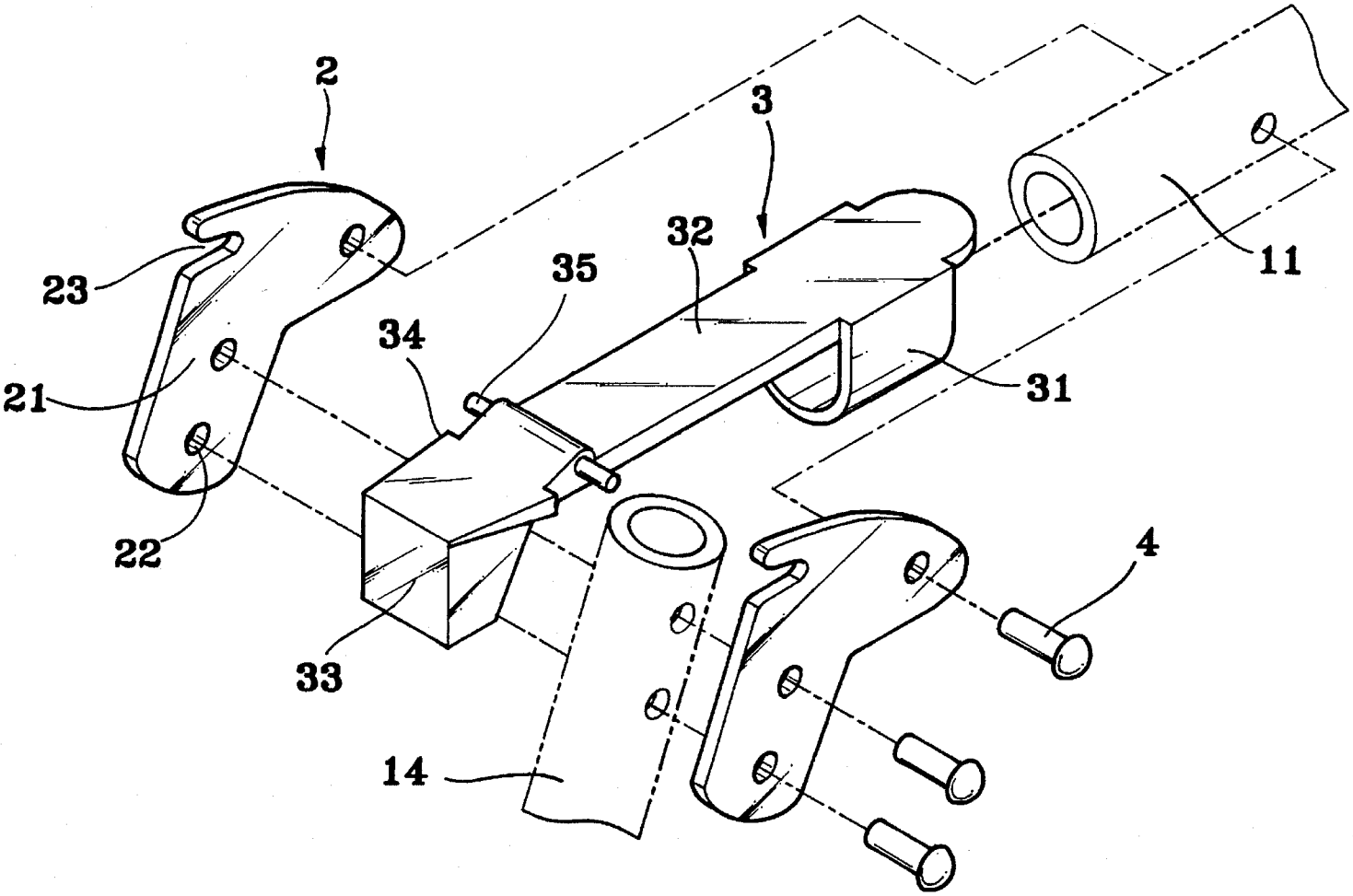
FIG. 3 is an exploded view of a folding collapsible stand mounting device according to the present invention.
Figure 4:
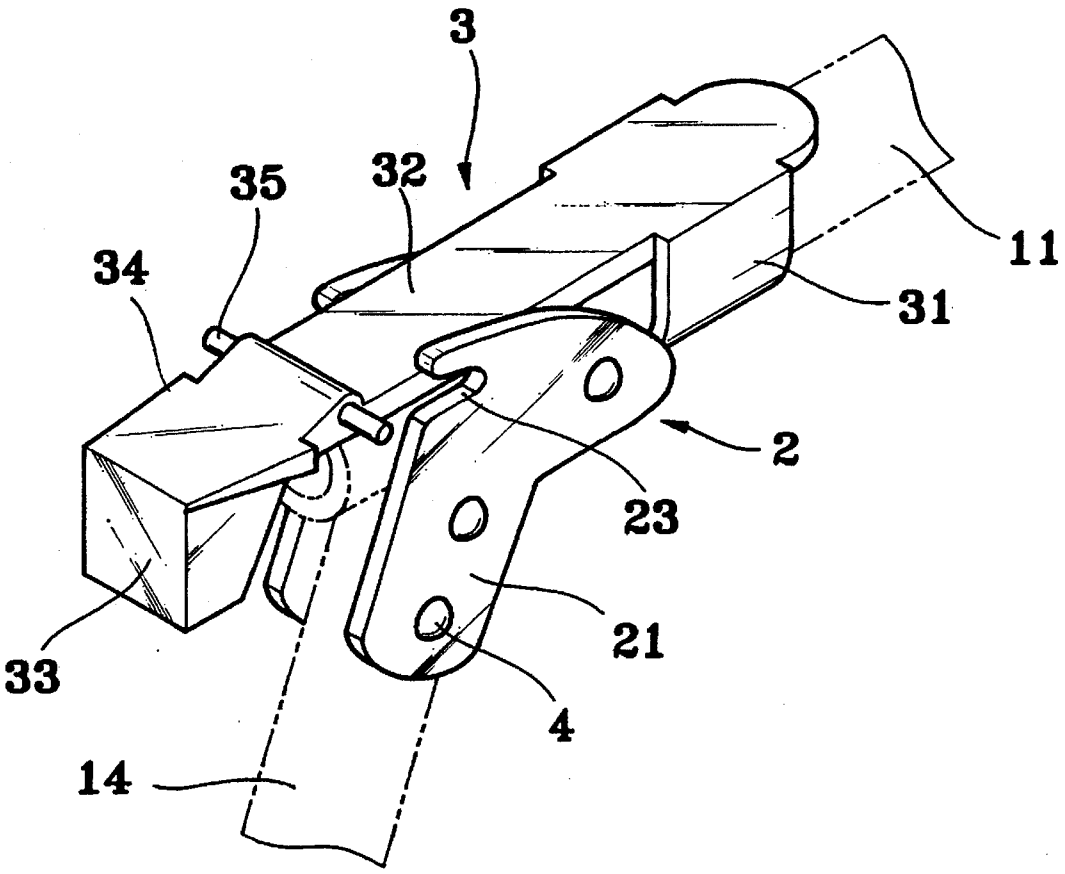
FIG. 4 is an assembly view of the folding collapsible stand mounting device of FIG. 3.

Referring to FIGS. 3 and 4, a folding collapsible stand mounting device in accordance with the present invention is generally comprised of a frame tube 11, a stand tube 14, a connector 2 connected between the frame tube 11 and the stand tube 14, and a sliding lock 3 controlled to lock the stand tube 14 in the operative position. The connector 2 is comprised of two substantially L-shaped connecting plates 21, each connecting plate 21 having a plurality of rivet holes 22 respectively connected to the frame tube 11 and the stand tube 14 by respective rivets 4. When stand tube 14 and the frame tube 11 are connected together by the L-shaped connecting plates 21, the stand tube 14 can be turned about the rivet on the frame tube 11 between the operative position and the collapsed position. The L-shaped connecting plates 21 further have a respective retaining hole 23 at a suitable location. The sliding lock 3 comprises a flat base 32, a barrel 31 formed at the front end of the flat base 32 and sleeved onto the frame tube 11 before the installation of the connector 2, an end cap 33 formed at the rear end of the flat base 32 and having two outward flanges 34 bilaterally disposed at the top for the holding of the hands during the operation of the sliding lock 3, and a transverse locating rod 35 disposed on the flat base 32 near the outward flanges 34. Through the outward flanges 34, the sliding lock 3 can be conveniently moved along the frame tube 11 by hand.

Figure 5:
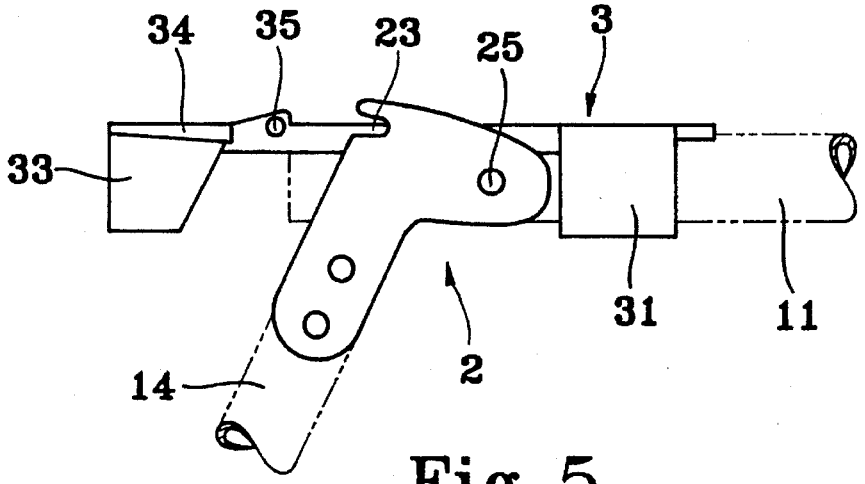
FIG. 5 is a side view of FIG. 4.
Figure 6:
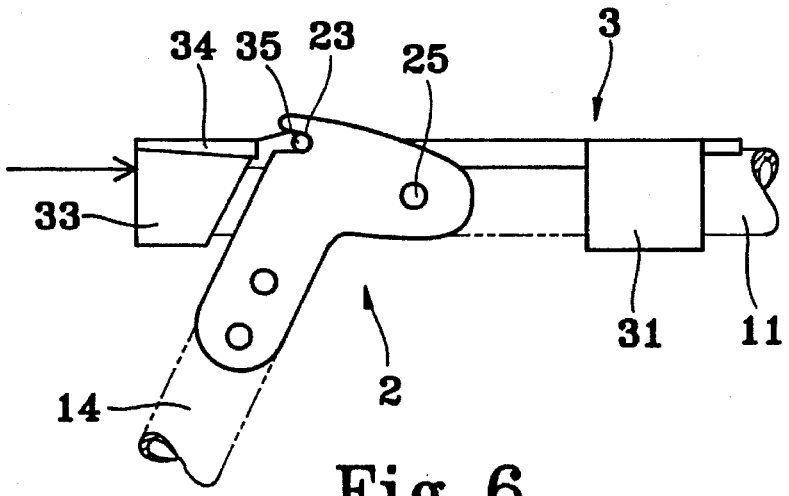
FIG. 6 is similar to FIG. 5 but showing the sliding lock moved to the locating position.
Figure 7:
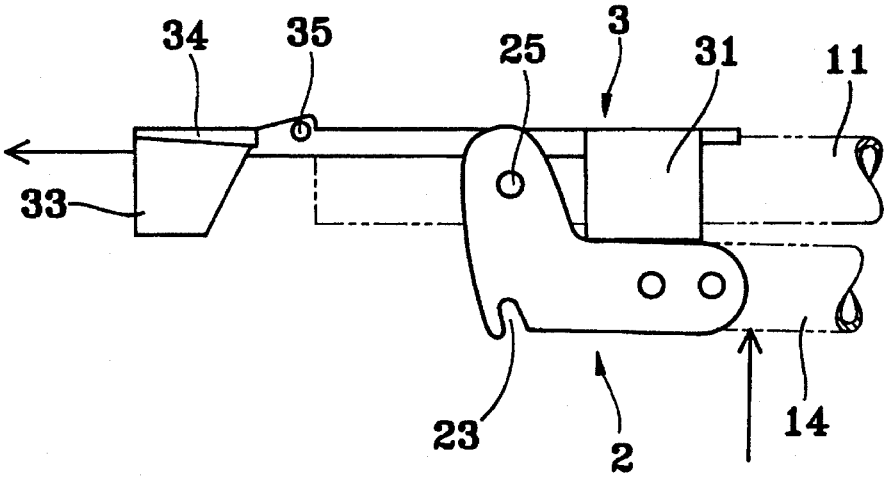
FIG. 7 is similar to FIG. 5 but showing the stand tube moved from the operative position to the collapsed position.

FIG. 5 is a side view of FIG. 4, showing the sliding lock 3 moved backwards from the frame tube 11 to the unlocking position. When the frame tube 11 is extended out, the sliding lock 3 is moved from the unlocking position to the locking position. When the sliding lock 3 is moved to the locking position as shown in FIG. 6, the transverse locating rod 35 is engaged into the retaining holes 23 on the connecting plates 21 and the end cap 33 is covered on one end of the frame tube 11, and therefore the stand tube 14 is stopped from being moved relative to the frame tube 11. When the sliding lock 3 is moved outwards from the frame tube 11 to release the transverse locating rod 35 from the retaining holes 23 and the end cap 33 from the frame tube 11, the stand tube 14 can then be turned inwards and closely attached to the bottom side of the frame tube 11 as shown in FIG. 7.

Figure 8:
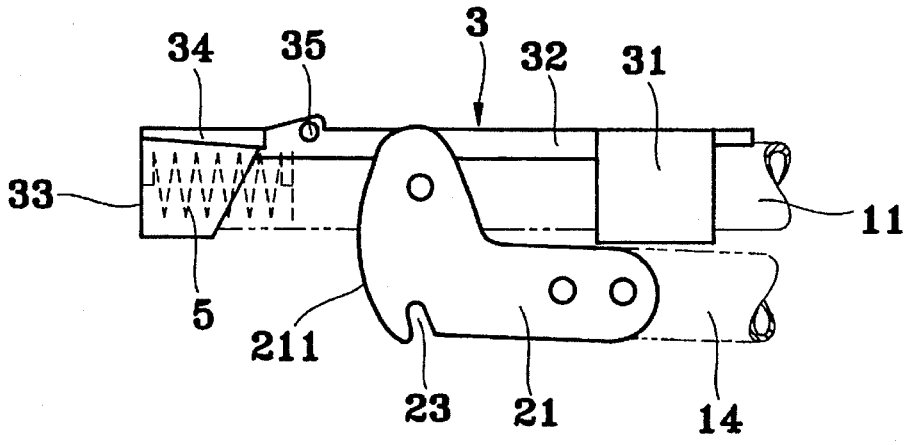
FIG. 8 shows an alternate form of the present inventions
Figure 9:
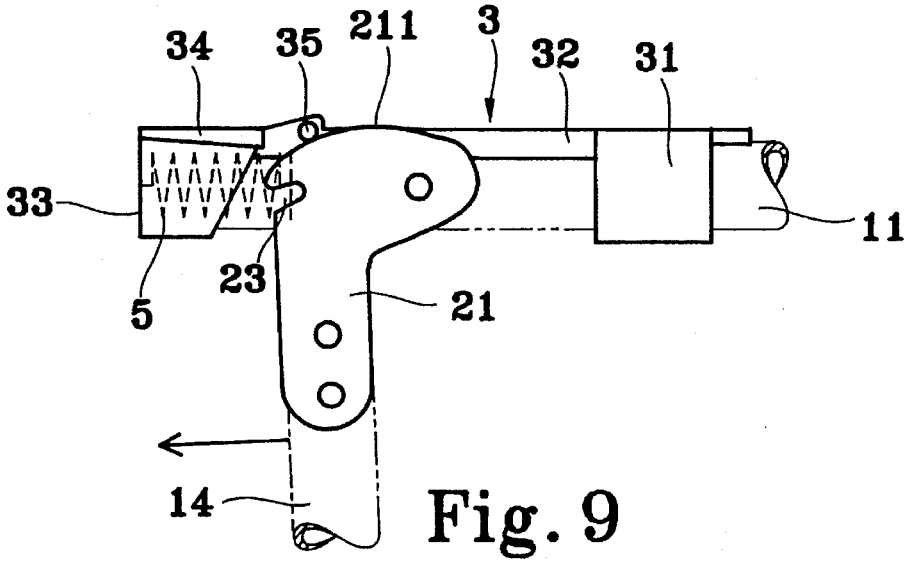
FIG. 9 is similar to FIG. 8 but showing the stand tube turned outwards from the frame tube.
Figure 10:
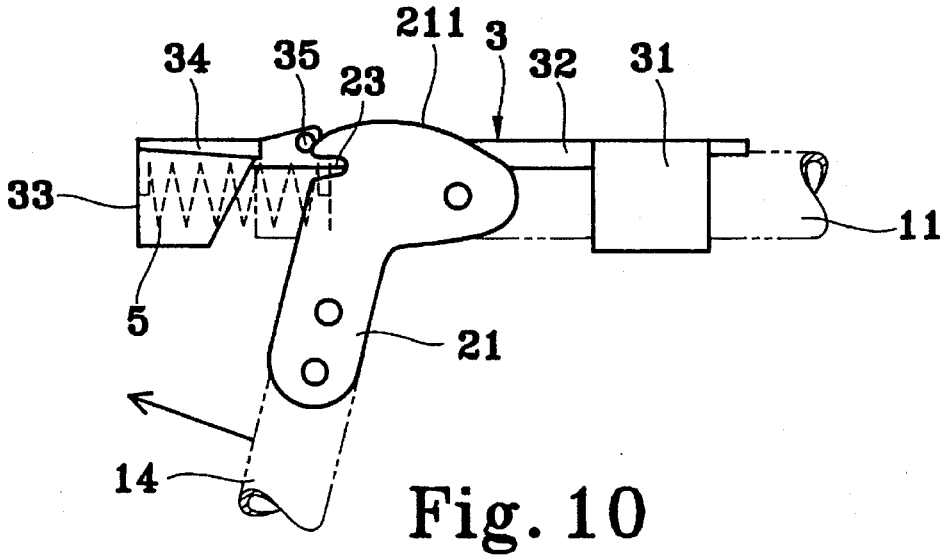
FIG. 10 is similar to FIG. 9 but showing the spring stretched outwards from the frame tube.
Figure 11:
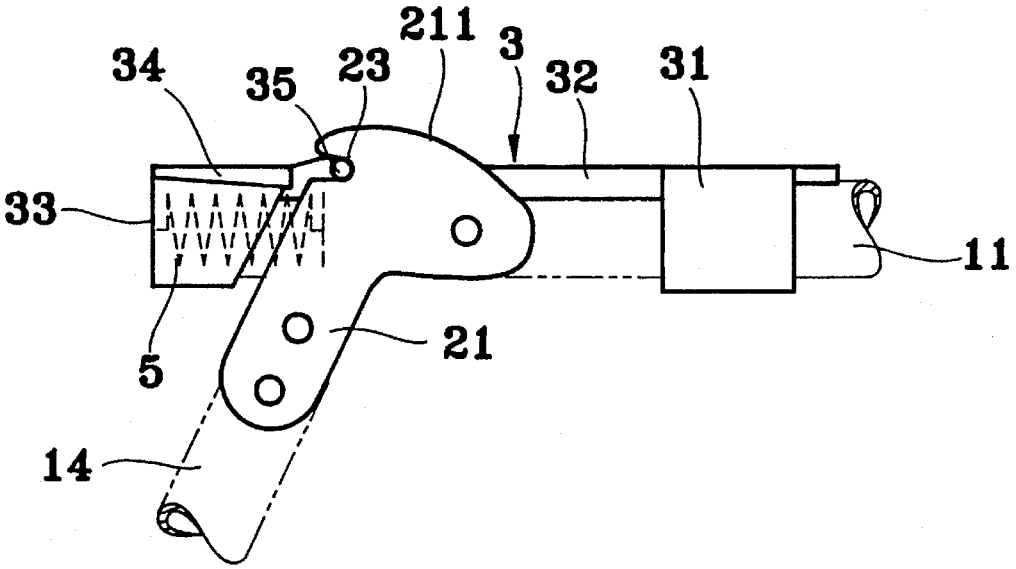
FIG. 11 is similar to FIG. 10 but showing the stand tube locked in the operative position.
Figure 12:
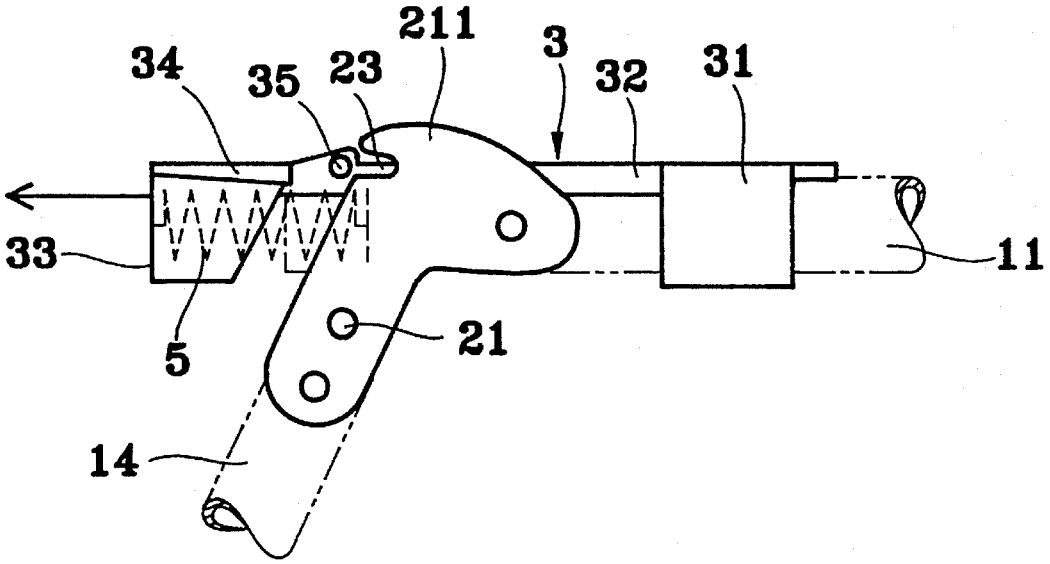
FIG. 12 is similar to FIG. 11 but showing the sliding lock moved from the locking position to the unlocking position.

FIG. 8 shows an alternate form of the present invention in which a spring 5 is connected between the frame tube 11 and the end cap 33 of the sliding lock 3; the connecting plates 21 have a respective arched edge 211 for guiding the transverse locating rod 35. When the stand tube 14 is extended out, the arched edges 211 of the connecting plates 21 are turned to force the transverse locating rod 35 outwards from the frame tube 11, causing the spring 5 pulled outwards from the frame tube 11 (see FIGS. 9 and 10). When the stand tube 14 is moved to the operative position, the sliding lock 3 is pulled inwards toward the frame tube 11, causing the transverse locating rod 35 engaged into the retaining holes 23 (see FIG. 11). To collapse the stand tube 14, the end cap 33 is pulled outwards from the frame tube 11 to release the transverse locating rod 35 from the retaining holes 23 (see FIG. 12), allowing the stand tube 14 to be turned from the operative position to the collapsed position and closely attached to the bottom side of the frame tube 11.

I claim:

1. A folding collapsible stand mounting device comprising a frame tube, a stand tube, two connecting plates connected between said frame tube and said stand tube permitting said stand tube to be turned relative to said frame tube between an operative position and a collapsible position, and a sliding lock mounted on said frame tube and moved between an unlocking position, in which said stand tube can be turned relative to said frame tube, and a locking position, in which said stand tube is locked in said operative position, wherein said connecting plates have a respective retaining hole; said sliding lock comprises a flat base having a barrel at a front end thereof, which is sleeved onto said frame tube, an end cap at a rear end thereof, which is covered on said frame tube when said sliding lock is moved to said locking position, and a transverse locating rod spaced between said barrel and said end cap, which transverse locating rod being engaged into the retaining holes on said connecting plate to stop said connecting plates from being turned relative to said frame tube when said sliding lock is moved to said locking position.

* * * * *